United States Patent [19]

Luedtke et al.

[11] 4,229,744

[45] Oct. 21, 1980

[54] DIRECTIONAL ANNULAR SLOT ANTENNA

[75] Inventors: Arthur Luedtke, Marietta; William F. Bentley, Smyrna, both of Ga.

[73] Assignee: The United States of America as represented by the Field Operations Bureau of the Federal Communications Commission, Washington, D.C.

[21] Appl. No.: 20,296

[22] Filed: Mar. 14, 1979

[51] Int. Cl.[3] ..... H01Q 13/12

[52] U.S. Cl. ..... 343/769; 343/713

[58] Field of Search ..... 343/769, 788, 713, 787, 343/711, 708, 776, 770

[56] References Cited

U.S. PATENT DOCUMENTS

| | | | |
|---|---|---|---|
| 2,508,085 | 5/1950 | Alford | 343/769 |
| 2,834,959 | 5/1958 | Dorne | 343/769 |
| 3,447,159 | 5/1969 | Stromswold | 343/788 |

*Primary Examiner*—David K. Moore

*Attorney, Agent, or Firm*—Wm. Ferrel Bentley

[57] ABSTRACT

This cavity-backed top-loaded annular slot directional antenna is particularly well suited for radio direction-finding applications. Its unique properties allow it to be flush mounted for camouflage use with three or more symmetrical outputs which may be sampled continually. Each output has a symmetrically related unidirectional beam pattern and is nearly constant in impedance. The radio frequency voltages at these outputs are symmetrically phase related, and when combined they produce a circular pattern. All of the antenna elements are in a single structure and the combined outputs are extremely uniform, thus producing reliable patterns such that amplitude comparison for radio direction-finding purposes will be of good accuracy. A single cardioid pattern can be obtained by simply terminating the other ports in a matched load. In this form the antenna would be well suited for use as one antenna in a large aperture array. A second or third antenna of the same type but different size may be installed concentric with the first to extend the range. The frequency bandwidth ratio of 1000 to 1 range is determined at the low frequency limit by the symmetry of the construction and the gain of the system, and at the high frequency limit when the diameter of the annular slot approaches one half wavelength.

5 Claims, 13 Drawing Figures

DIRECTIONAL ANNULAR SLOT ANTENNA

A FIELD OF THE INVENTION

This invention relates to antennas, in which the aperture is a narrow annular slot on a flat conductive sheet with a hollow cavity backing on one side. In particular, this antenna is broad band, directional, has multiple outputs, and is suitable for use in a radio direction-finding application.

DISCUSSION OF THE PRIOR ART

Annular slot antennas have traditionally been used as an effective omnidirectional antenna, particularly on aircraft where aerodynamics is a problem. The use of annular slots as a directional device has primarily been limited to two port switching devices wherein one side is terminated and the other side is the feed point. The usual construction is to have a continuous narrow annular cavity beneath the slot. There is a tactical need for a flush mounting direction finding antenna with continuous outputs and full azimuth information for mobile use such as in an automobile. Switching types destroy the intelligence on the signal which is being monitored. Homing types do not provide sufficient azimuth information. External antennas are unsightly and make the DF car obvious not only for undercover work but also to vandals.

SUMMARY OF THE INVENTION

It is the object of this invention to provide an antenna system for receiving vertically polarized RF energy. It is another object of the present invention to provide multiple directional patterns simultaneously in such phase relationship that when combined the outputs will produce an omnidirectional pattern. It is another object of this invention to provide such an antenna in a flush mounting package with continuous ground plane such that the antenna will function down to a fraction of the wavelength of the received signal. It is another object of the invention to provide an aperture of a narrow annular slot radiator on a conductive surface with inductive reactance, which when added to the capacitive reactance of the center top loaded radiator will produce a reasonable impedance match over a wide bandwidth, such that the RF patterns will maintain usable directional information over a wide bandwidth.

BRIEF DESCRIPTION OF THE DRAWING

The invention will be readily understood in light of the description of the illustrative embodiment of the present invention which follows. In the drawings which form part of the disclosure, like reference numerals refer to like elements.

DESCRIPTION OF THE PREFERRED EMBODIMENT

Figure 1:
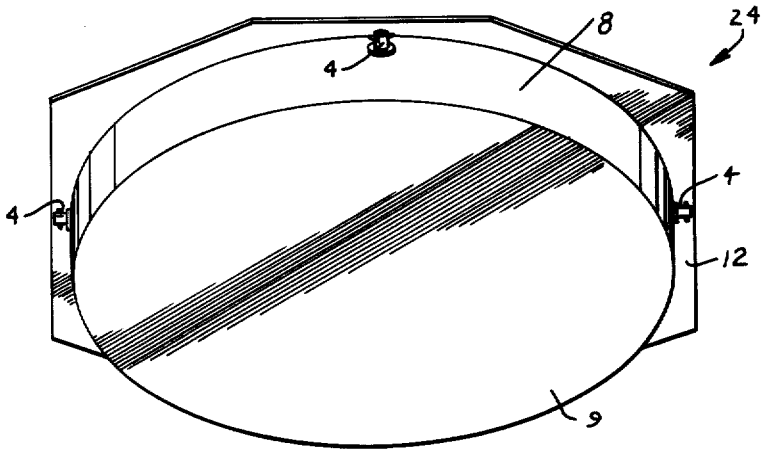
FIG. 1 illustrates a perspective view of the preferred embodiment of the invention.
Figure 2:
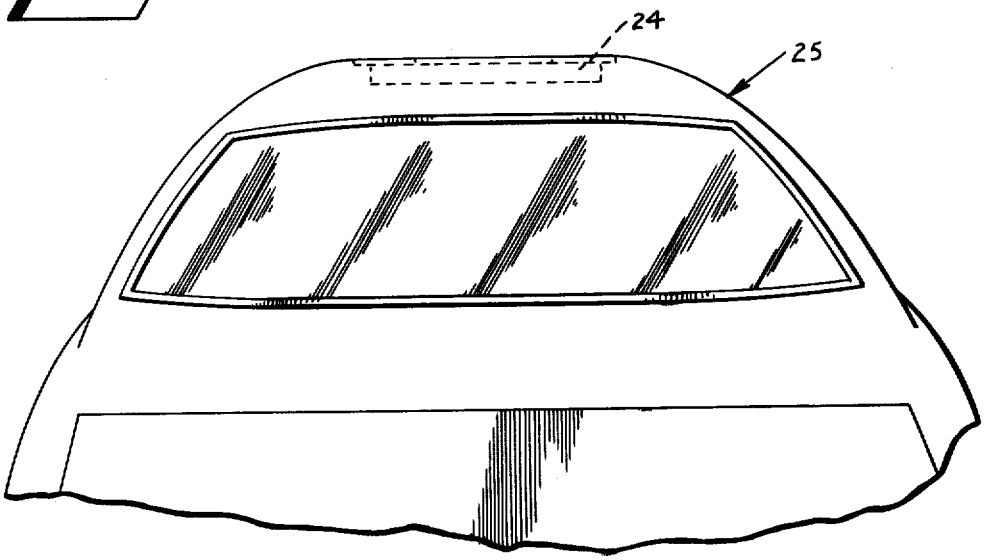
FIG. 2 illustrates the embodiment of the antenna as a system.
Figure 3:
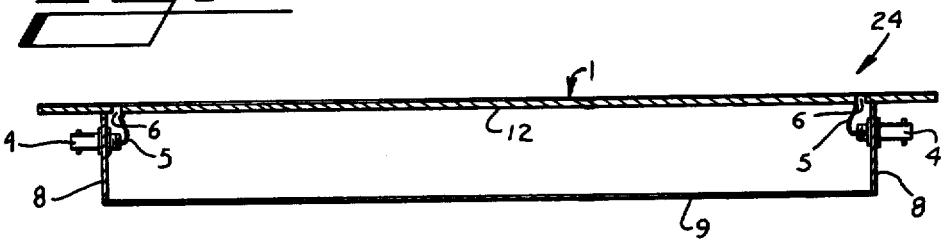
FIG. 3 illustrates a plane section view of the basic antenna.
Figure 4:
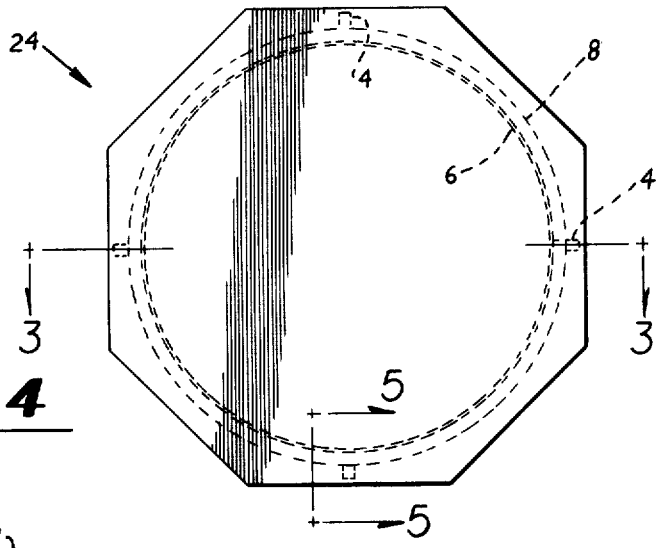
FIG. 4 illustrates the top view of the basic antenna.
Figure 5:
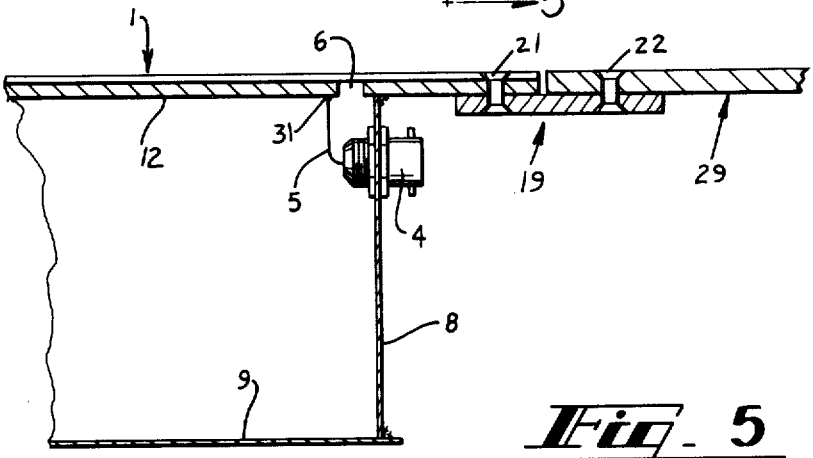
FIG. 5 illustrates the details of the radio frequency connection, and mounting procedure.
Figure 6:
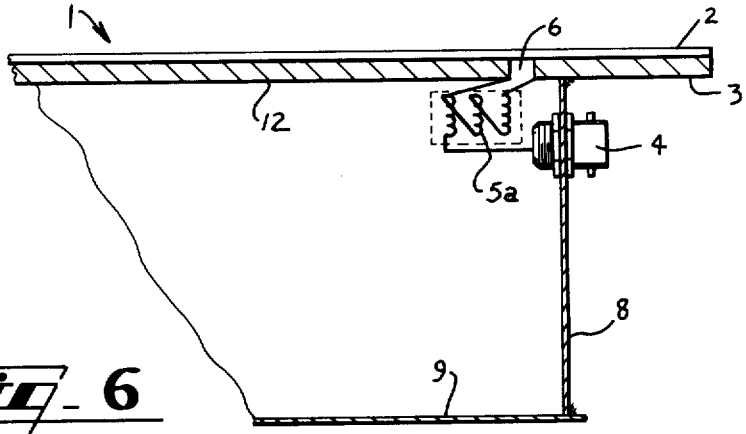
FIG. 6 illustrates the details of a second type of radio frequency connection.
Figure 7C:
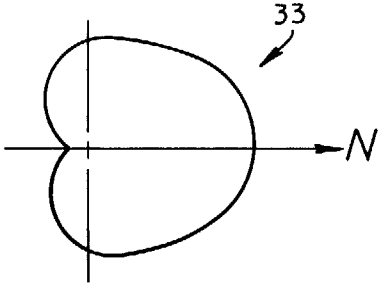
FIG. 7A, 7B, 7C illustrates the radio frequency amplitude receiving patterns with respect to the azimuth of the antenna, from any one given port slot pickup, top loaded antenna pickup, and sum pickup respectively.
Figure 7B:
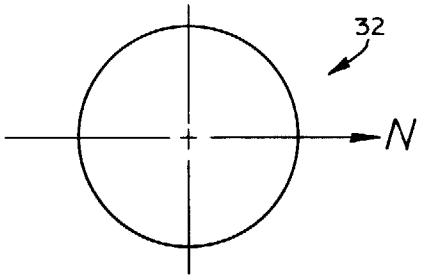
Figure 7A:
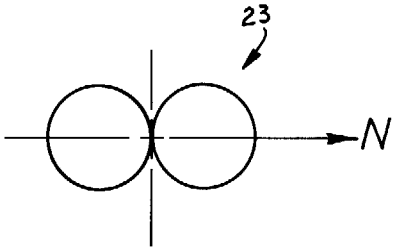

FIG. 1 illustrates a perspective view of the preferred embodiment of the quadrature directional antenna 24 before it is attached to a ground plane. FIG. 2 illustrates the preferred embodiment of the antenna 24 as it would be installed in an automobile 25. FIGS. 3, 5, and 6 are section views of the basic antenna, with cavity wall 8 and cavity bottom cover 9. The received radio frequency signal is transmitted through the connecting wire 5 to the output jack 4. The supporting structure 1 for the center pick-up element 12 is also used for mounting the antenna to the ground plane 29. The supporting structure 1 is made up of G-10 fiberglass 2 laminated to a copper sheet 3. The center antenna section 12 is made by cutting an annular slot 6 in the thin copper sheet 3. The signal carrying wire 5 is attached to the antenna 12 by soldering 31. This connection 5 can be replaced by a resistive matching network or a radio frequency matching transformer 5A. The antenna structure is attached to the ground plane by a metallic strip 19 for flush mounting, and the use of rivets 21 and 22. FIG. 7A, 7B, 7C illustrates the radio frequency amplitude receiving patterns for various possible outputs.

Figure 8:
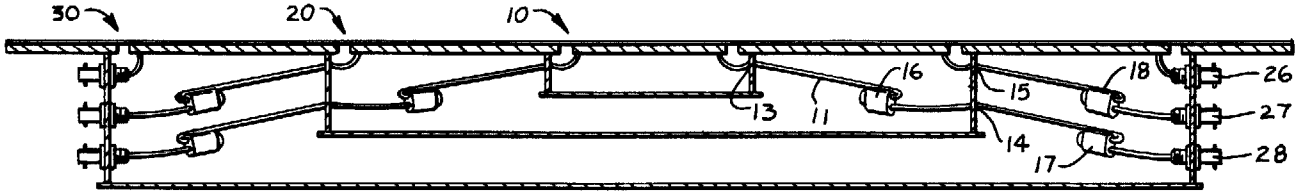
FIG. 8 illustrates a modified section view for an antenna with extended frequency range.
Figure 9:
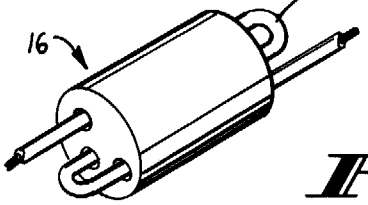
FIG. 9 illustrates a perspective view of the ferrite isolation beads on the coaxial cable.
Figure 10:
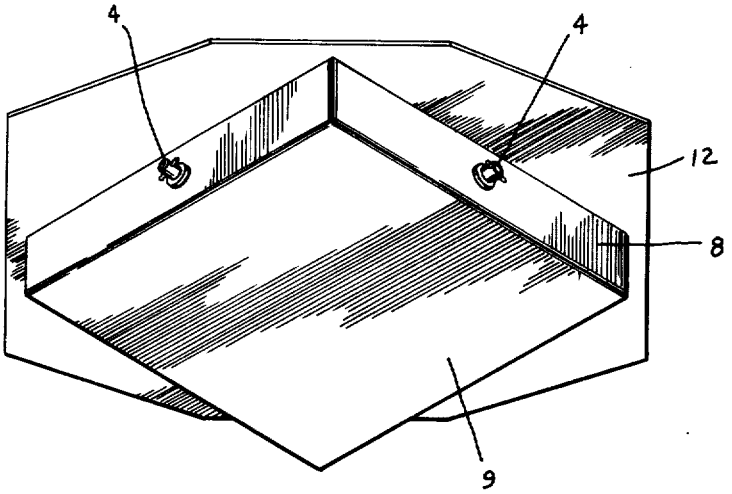
FIG. 10 illustrates a perspective view of the square embodiment of the antenna.
Figure 11:
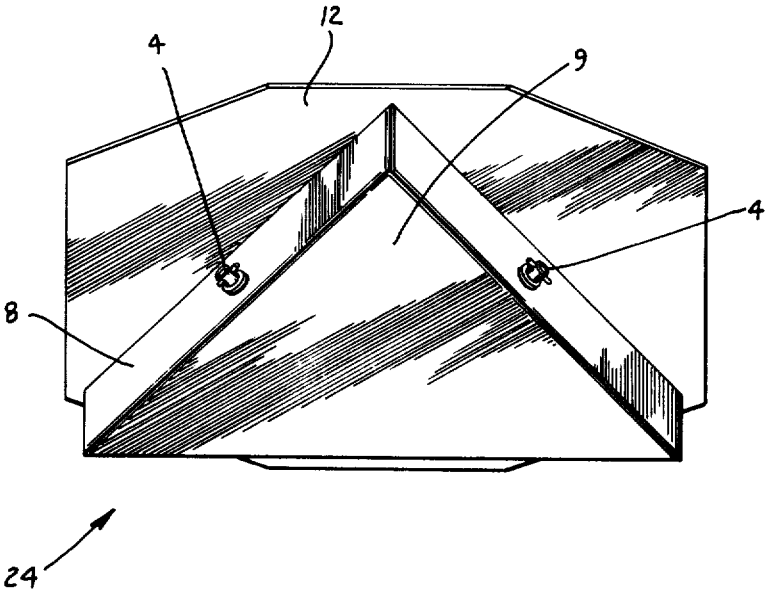
FIG. 11 illustrates a perspective view of the triangular embodiment of the antenna.

When using the north antenna output the radio frequency amplitude output for the slot effect only would have an azimuth representative pattern as in 23. This slot responds to the electromagnetic radiation portion of the vertically polarized RF field. The center element is a top loaded vertical antenna responding to the electrostatic radiation portion of the vertically polarized RF field and its amplitude pattern would have an azimuth representative pattern as in 32. When these two patterns are combined within limits the output radio frequency amplitude pattern would be representative in azimuth by 33. The amplitude ratio of the two signals must be relatively constant over a wide range of frequency. With the proper cavity depth and slot width and impedance matching, the outputs can be maintained within tolerance so that the pattern will in fact be consistent. The gain with respect to absolute antenna gain will be decreasing at the rate of 6 to 12 dB per octave with decreasing frequency. However, for this type of undercover antenna, the pattern or directional characteristics are the most important features. The slot antenna has inductive reactance and the center vertical antenna has capacitive reactance; when these are summed in phase the output is relatively constant and primarily resistive. With proper matching an antenna can represent a nominal 50 ohm impedance over a frequency ratio of 100 to 1. FIG. 8 illustrates the preferred embodiment of a multiantenna concentric array made up of three independent antennas; the smallest antenna 10 for higher frequency reception, the medium size antenna 20 for mid-band reception, and the largest antenna 30 for lower frequency reception. Installing the smaller antennas inside the larger ones has the effect of increasing the top loading on the center section. This may be partially compensated for by increasing the slot width. A typical antenna of this type would have frequency range from 500 kHz to 1000 MHz. The top frequency for each antenna would be 200 MHz, 500 MHz, and 1000 MHz; for a slot size of 22", 9", and 4" respectively; with a cavity depth of 2", 1.5", and 0.75" respectively and a slot width of 0.19" for all slots. The maximum gain of each antenna is approximately −12 dBi and is relatively flat for the top 30% of the frequency range, but decreases at the rate of 10 dB per octave below that. In this array, each antenna must be isolated from the others within its own frequency range. This is accomplished by decoupling, the coaxial cable 11 output means through appropriate application of ferrite beads. FIG. 9 illustrates the means for decoupling the RF path on the shield of the coax cable 11 along its length. The ferrite bead 16 should have high permeability in the rejection frequency range, so that the isolation will be maintained between the antennas. The shields of the coaxial cables are grounded 13, 14, 15 as they enter or exit each separate cavity. Each cable exits through the side of the cavity to RF fittings 26, 27, 28. An alternate output means is to modulate and combine the four quadrature outputs inside the antenna by means of amplitude or phase modulation and then bring one RF cable out with the sum information.

With the antenna mounted in an automobile as in FIG. 2 and signal arriving from the right the maximum signal amplitude will be produced at the right port with the minimum signal at the left port, and the front and rear ports will be equal but somewhat less than the right port. This should yield an ideal set of RF signals that are in phase quadrature such that if the outputs are modulated either by sine waves or square waves the combined output will be an omnidirectional signal with the directional information superimposed on the signal in the form of amplitude modulation and the phase angle of this added modulation represents the azimuth information. In other antennas where direction finding is performed by AM modulation of antenna patterns, the antenna's maximum front to back ratio occurs when the antenna elements are ¼ wavelength apart and the pattern becomes non-directional above ⅜ wavelength. In comparison, this directional annular slot antenna may be used up to a frequency where the diameter of the slot is ½ wavelength. This gives more gain and a broader aperture for more accuracy. This antenna is superior because each output port sustains its own directional pattern rather than the pattern being derived from a combination of ports. The lower limit of the antenna's useful range is determined by the gain of the system. In undercover activities the gain of the system must often be sacrificed if the antenna is to be truly inconspicuous. The gain-bandwidth product of the antenna can be improved by the use of multiple antennas concentrically placed in an array as shown previously. The lowest usable frequency is then determined by the gain and sensitivity of the complete direction finding receiving system along with and including the available field intensity.

Match transformers or networks at the antenna may be used to improve wide bandwidth operation by reducing the standing waves on the coaxial cables to help match the slot response with the top loaded response. Various modifications are contemplated and may obviously be resorted to by those skilled in the art without departing from the spirit and scope of the invention as herein defended by the appended claims, as only a preferred embodiment thereof has been disclosed. The antenna may be mounted in the roof of an automobile or underneath the automobile, or in other types of vehicles. It works equally well in aircraft, and is not limited to use in mobile application. Indeed its use as a fixed location antenna would be effective, when used in a circular array of antennas in which one output port of each antenna is used and all other ports are terminated in the antenna characteristic impedance. Each antenna of this circular array will have a pattern directed outwards from the array and can be sequentially sampled. Since the accuracy of the system is proportional to the diameter of the array it is advantageous to have a large number of antennas.

The minimum preferred symmetrical ground plane around the smaller slot antenna is one wavelength at the lower frequency limit. If the ground plane is too small or asymmetrical, the radiation from the edge of the ground plane couples with the radiation from the antenna and causes a ripple effect in the pattern and the impedances at the output ports. Thus the small ground plane available on an automobile affects the directional accuracy at lower frequencies.

What is claimed:

1. A concentric broadband antenna array with regular polyangular directional patterns, in which the sum of all patterns produce an omni directional pattern, this antenna comprising:

a support means for a plane conductive sheet with a plurality of concentric narrow annular slots forming an inner conductive sheet and an outer conductive sheet around each slot, having a continuous metallic wall attached to said outer conducting sheet adjacent to each said slot, forming an array of cylinders and being closed at the bottom end of each with a metallic sheet, forming an independent cavity beneath each said annular slot; a feed means, which are symmetrically attached across each said annular slot to carry an RF signal from each respective directional antenna pick up pattern to a coaxial cable for carrying an RF signal to an output means in outer most said wall, said coaxial cable shield is grounded at each said slot wall, and has an isolation means along said coaxial cable between each succeeding said cavity wall.

2. The antenna according to claim 1 and in which the annular slots have three or more sides with angular symmetry between said sides and feed means.

3. The antenna according to claim 2 and in which said support means is a copper clad insulating board with the walls and bottom made of metallic sheet which are soldered at the outside of said slots to the outer said conducting sheet.

4. The antenna according to claim 3 and in which the diameter of each said slot antenna is equal to one half the wavelength of the upper frequency limit of the antenna, the cavity depth not exceeding ¼ wavelength at the upper frequency limit, said cavity depth less than two thirds the depth of the next larger cavity it occupies, and slot width typically 3/16".

5. The antenna according to claim 4 and in which one said output is used to produce a single directional antenna pattern with all remaining outputs terminated in the said slot antenna's characteristic impedance.

* * * * *